United States Patent [19]

Gongwer

[11] 4,377,982

[45] Mar. 29, 1983

[54] SPHERICAL VEHICLE FOR OPERATION IN A FLUID MEDIUM

[75] Inventor: Calvin A. Gongwer, Glendora, Calif.

[73] Assignee: The Bendix Corporation, North Hollywood, Calif.

[21] Appl. No.: 187,923

[22] Filed: Sep. 17, 1980

Related U.S. Application Data

[63] Continuation of Ser. No. 883,775, Mar. 6, 1978, abandoned.

[51] Int. Cl.[3] ..... B63G 8/08; B63G 8/20

[52] U.S. Cl. ..... 114/312; 114/56; 114/338; 244/199

[58] Field of Search ..... 114/312, 330, 331, 332, 114/338, 56; 244/200, 204, 199, 213, 140; 405/185

[56] References Cited

U.S. PATENT DOCUMENTS

| | | | |
|---|---|---|---|
| 2,291,940 | 8/1942 | Babcoke | 114/338 X |
| 2,764,373 | 9/1956 | Anderson et al. | 244/199 X |
| 3,292,564 | 9/1966 | Lehmann | 114/338 X |
| 3,371,635 | 3/1968 | Seeley | 114/338 X |

FOREIGN PATENT DOCUMENTS

| | | | |
|---|---|---|---|
| 1158537 | 6/1958 | France | 244/140 |

*Primary Examiner*—Sherman D. Basinger
*Attorney, Agent, or Firm*—Robert C. Smith; William F. Thornton

[57] ABSTRACT

A spherical vehicle for operation in a fluid medium utilizes an impeller of approximately half the diameter of the sphere for propulsion. In addition to providing the energy for driving the sphere, the propeller acts to draw the flow of fluid smoothly over the after part of the sphere, thus avoiding or minimizing the tendency of the flow to separate from the surface of the sphere and create turbulence. Steering in pitch and yaw planes is effected through the use of a plurality of drag pins located just behind the circle of maximum diameter (with respect to the direction of motion) and selectively actuated by a guidance or control system. A plurality of stub vortex generators are also located on the after side of the sphere and are angled to oppose the torque created by the propeller. The center of gravity is located substantially below the geometric center of the sphere. The particular embodiment shown is an electrically (battery) powered underwater vehicle, but the same general configuration also applies to a lighter-than-air vehicle traveling through air, or to a manned submarine vehicle having the usual propulsion system.

10 Claims, 9 Drawing Figures

FIG. 2
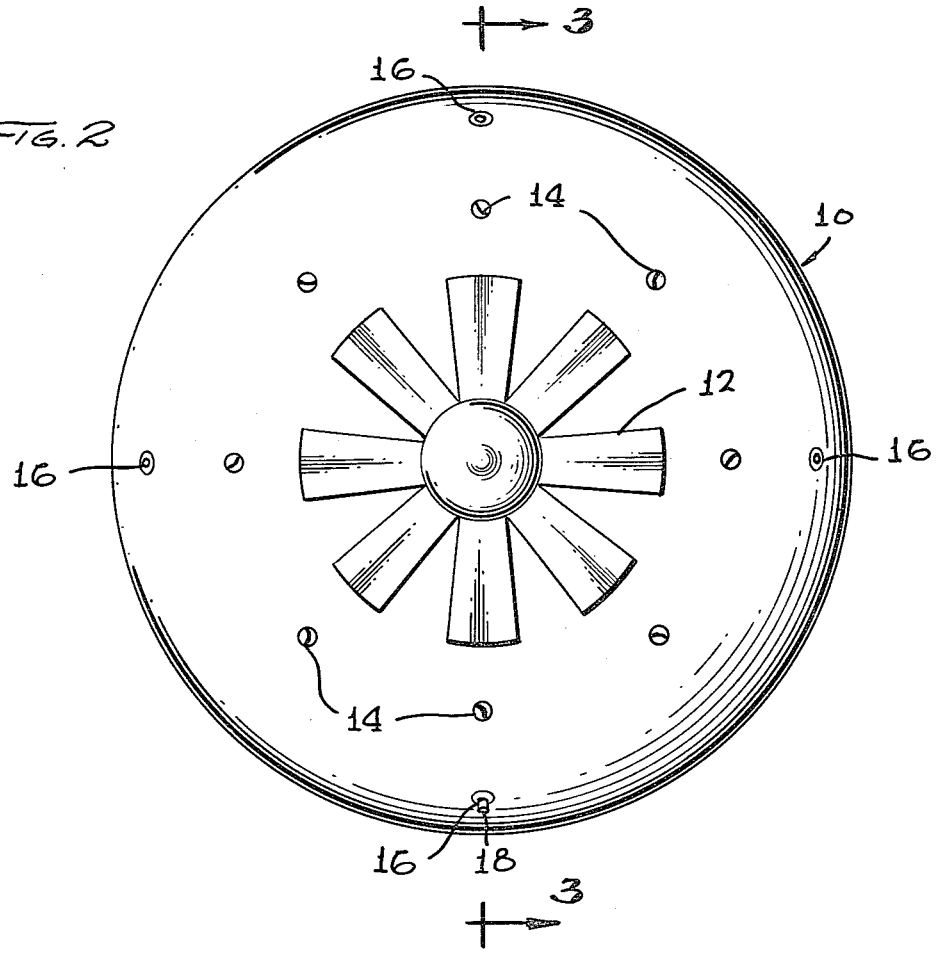
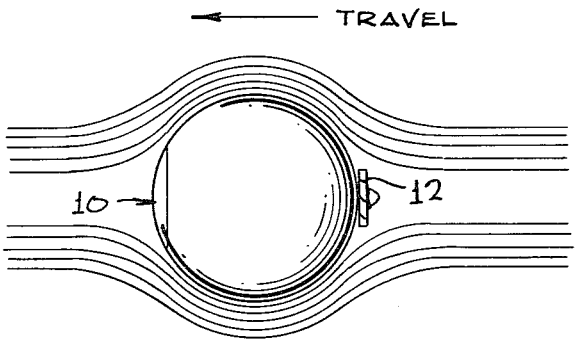
FIG. 1
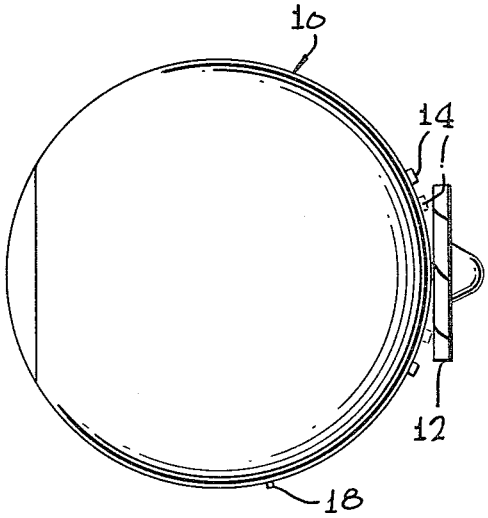
FIG. 5

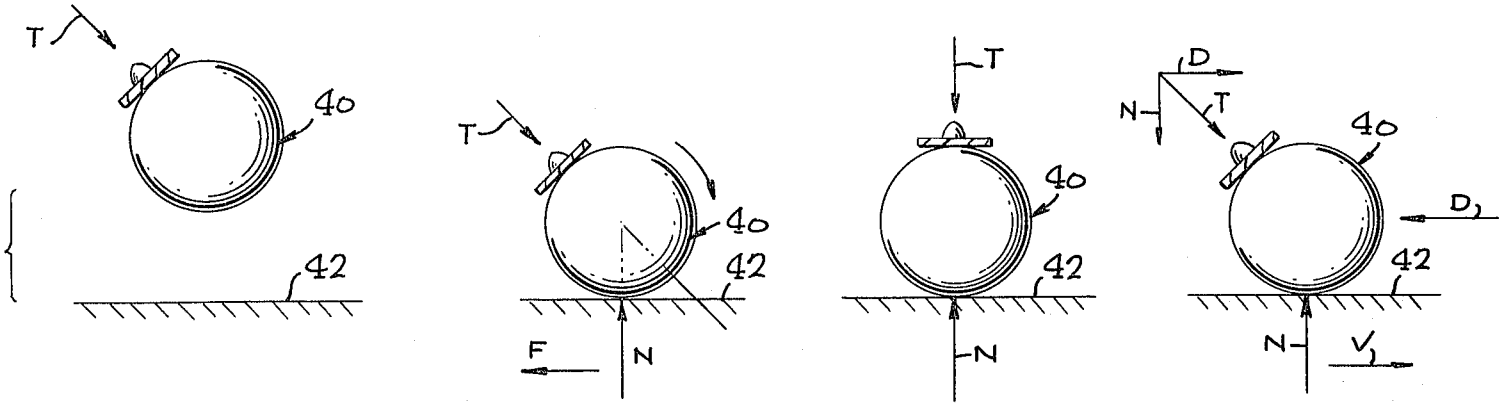
FIG. 6(a)
FIG. 6(b)
FIG. 6(c)
FIG. 6(d)
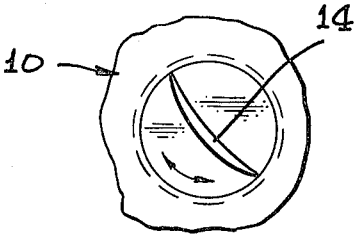
FIG. 9

SPHERICAL VEHICLE FOR OPERATION IN A FLUID MEDIUM

This is a continuation of application Ser. No. 883,775 filed Mar. 6, 1978 now abandoned.

BACKGROUND OF THE INVENTION

The configuration of powered underwater vehicles has evolved through many years based on certain understood hydrodynamic and mechanical requirements. Aerodynamic considerations have resulted in somewhat similar shapes for lighter-than-air vehicles such as dirigibles and blimps. Where significant velocity through the fluid medium is required, the art seems to have settled on a generally tubular shape, rounded at the front and tapering toward the rear with the diameter made as small as the internal mechanism and/or flotation requirements will permit to minimize frontal area. This general configuration has been evident in the usual configuration of airships, of manned submarine vehicles and of unmanned vehicles such as torpedoes. The power required to drive such a vehicle through the fluid medium varies with factors such as the effective frontal area, skin friction, and drag caused by separation of the flow over the surface of the body resulting in turbulence. A conventional way of avoiding flow separation over the rearward surfaces of such vehicles is to provide a tapering surface free of abrupt discontinuities with a propeller or impeller at or toward the rear.

Because of certain obvious advantages, some efforts have been made to fabricate and test experimental vehicles of spherical configuration. Such vehicles have inherently greater internal volume relative to their surface area than other shapes, and they have greater resistance to external pressure so can be lighter than conventional shapes because of less need for internal bracing or ribs. With greater diameter and less internal bracing required, a spherical vehicle could accommodate larger objects within than a tubular vehicle of comparable cubic content. Where a sonar must be incorporated, the larger diameter permits the use of a transducer array of much greater area than can be accommodated at the front of a tubular vehicle, so much better sonar performance could be realized.

Despite the above and possible other advantages of a spherical body for underwater vehicles, they have not been used in the past because testing has indicated that such bodies are inherently unstable. Generally spherical lighter-than air vehicles have been used as balloons, but not as dirigibles or blimps, probably because the frontal area appeared excessive. When attempts were made in the past to move a spherical body through the water at any significant velocity, the boundary layer flow in the aft part of the sphere became separated at first one radial position and then another. This results in a low pressure at the separation region while high pressures act elsewhere, causing the sphere to be slowed toward the low pressure region. This displacement results in slowing of flow in said first region which causes the flow to again become attached there but to become detached elsewhere. The sphere will then move toward the new low pressure region. This phenomenon applicable to both air and water vehicles will continue causing the vehicle to tend to oscillate back and forth. Not only is the oscillation unacceptable, but the drag becomes prohibitive and so also does power consumption. At the present time a further disadvantage is that all sorts of existing storage and mooring facilities, from hangars to harbor berths to torpedo tubes, are designed to accommodate the above described tubular shaped vehicles.

SUMMARY OF THE INVENTION

The problems of abrupt and erratic discontinuities in boundary layer flow discussed above can be dealt with if the spherical vehicle has an impeller of proper size and type at the rear which acts as a jet pump to pull the flow together around the sphere. If separation and turbulence does begin to occur, the pump (impeller) will promptly exhaust the dead air or water and re-establish the attached flow pattern. The impeller inducts part of the boundary layer and adds sufficient energy to restore its downstream velocity to just over the free stream velocity. This results in a nearly "wakeless" propulsion where the wake is left with no, or very little, absolute velocity. It appears that the system is optimized when about half the boundary layer is inducted. It also appears that the inducted water has had kinetic energy added to it by the drag process which lessens the shaft power required for a given thrust.

Steering is effected through the use of drag pins operated by suitable actuators. Since the sphere has almost neutral stability, it is easily turned in yaw and pitch. The drag pins are operated by their actuators such that, when a change of direction is desired, a selected pin or pins extend outwardly a variable amount from the surface of the housing, creating a drag force which is used to rotate the sphere. When on course, the pins are flush with the surface. The drag force has a large lever arm about the center of gravity of the vehicle so a small force is sufficient to effect the desired rotation. In this way it is possible to eliminate various control surfaces, tail fins, etc., which add considerable drag whether actually in operation or not, and which require some care in handling to avoid damage thereto. The area of such drag pins, to be effective, is of course variable with requirements depending upon the size of the spherical vehicle, the fluid medium, etc.

In some applications it may be necessary or desirable to include a plurality of stub wing vortex generators which assist in preventing separation of the flow and to direct flow into the impeller or propeller and which also provide a means for compensating for torque of the impeller or propeller. Such stub wing vortex generators may also be controlled to provide roll stabilization.

DESCRIPTION OF THE DRAWINGS

FIG. 1 is a diagrammatic plan view of a vehicle according to my invention shown in relation to the fluid medium in which it operates;

FIG. 2 is a plan view, from the rear, of a vehicle incorporating my invention;

FIG. 4 is an enlarged view of a portion of FIG. 3 on line 4—4 of FIG. 3.

FIG. 5 is a side plan view, on a reduced scale, of an additional embodiment of my invention.

Figure 3:
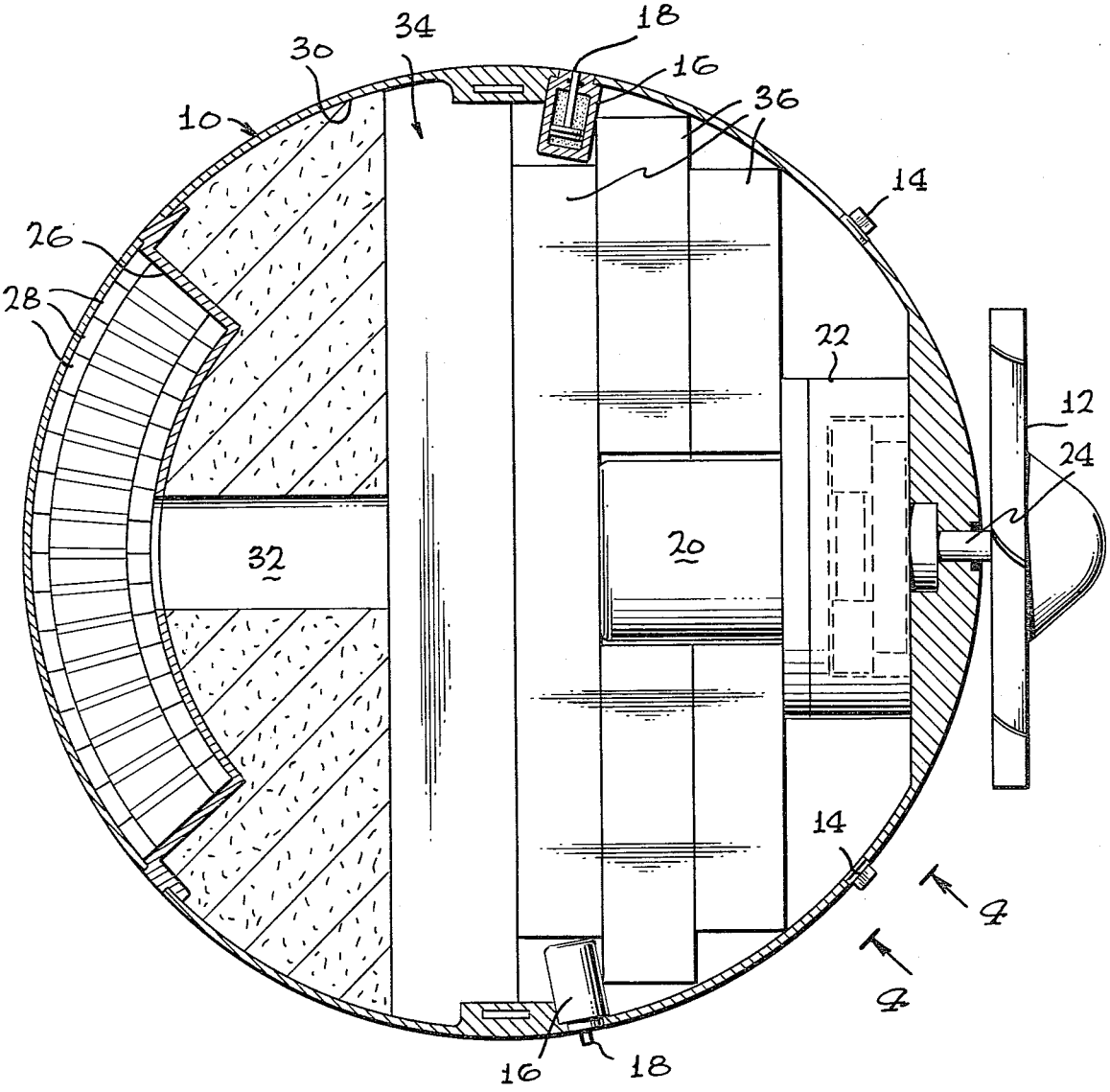
FIG. 3 is a sectional view of the vehicle of FIG. 2, taken along line 3—3 of FIG. 2.

FIGS. *6a–6d* constitutes a series of diagrams showing an operating characteristic of a vehicle made according to FIGS. 1 through 5.

DESCRIPTION OF THE PREFERRED EMBODIMENT

Referring now to FIG. 1, a spherical vehicle 10 having an impeller 12 at the rear which is of the actuation disk type is shown in conjunction with a flow pattern representing the fluid medium in which it is moving. This fluid medium may be gaseous (air) or liquid (water), and the flow pattern is similar. Where a sphere is moved at substantial velocity through a fluid medium, the flow pattern toward the rear typically becomes detached, breaking down into areas of low and high pressure and turbulence which cause the sphere to move in an unstable manner with a significant amount of sideways movement resulting in considerable drag. The impeller 12 serves to pull the flow pattern toward itself, causing flow to remain smooth and attached to the wall of the sphere until it passes through the impeller. The impeller diameter will normally be approximately one-half the diameter of the sphere, and the usual clearance between the impeller tip and the spherical vehicle is about 7% of the sphere diameter.

In FIG. 2 a spherical vehicle is shown in plan view from the rear having a housing 10 and a rear mounted impeller 12. Forward of the impeller 12 are a series of small flow-directing tabs or stub vortex generators 14 which assist in preventing separation of the flow. They are also angled to provide a net torque counter to the impeller reaction which reduces the roll effect of the shaft torque. Still further forward and just aft of the circle of maximum diameter with respect to the direction of flow are a plurality of small actuators 16 (which may be hydraulic or solenoid-type actuators) which operate to move a plurality of drag pins 18 in and out with respect to the surface of the housing 10 for control in the yaw and pitch planes.

FIG. 3 is a sectional view taken along line 3—3 of FIG. 2. In this view the housing 10 is shown containing an electric motor 20 connected to a gearbox 22 having an output shaft 24 connected to the hub of the impeller 12.

At the very front of the housing 10 is a recessed chamber 26 of large area which contains an array of sonar transducers 28, some for transmitting a sonar signal and some for receiving echoes of the transmitted signal. Immediately behind the chamber 26 is a space for payload 30 with a channel 32 therethrough for wiring, etc., connecting the sonar transducers 28 to a guidance and control system 34. Immediately behind the guidance and control system are a plurality of batteries 36 for providing propulsion to the impeller 12 as well as energy for the guidance and control system.

The drag pin actuators 16 are controlled by a guidance system to extend as needed for steering. Typically there will be a pair of such drag pins and actuators for steering in yaw and another pair for pitch control. Since the vehicle should be constructed such that the center of gravity is substantially below the geometric center of the vehicle, roll control will not normally be a problem. Obviously the stub vortex generators 14 provide some roll control, and some or all may be made adjustable in operation, if desired. While a ring of such stub vortex generators is shown in FIG. 1, smaller numbers of such generators may be sufficient, and some or all of these may be either rotatable or selectively retractable in the same way as the drag pins 18 for roll control. Those skilled in the art will recognize that there are a number of ways of implementing the control surfaces described above for control in the roll plane.

It will be apparent that the particular vehicle thus far described would have maximum utility as a torpedo although a manned vehicle would be essentially the same with respect to control. The battery-type propulsion, of course, would normally be replaced with a type of prime mover typical of submarines such as diesel-electric systems, nuclear power plants, etc.

FIG. 4 is an enlarged view of a portion of FIG. 2 showing a single stub vortex generator 14. While the particular generator shown is indicated as a slightly cambered stub member which is manually oriented to the desired setting and then retained in position, as by a set screw, such members may be retractable through means such as the actuators controlling the drag pins or rotatable in operation by suitable rotary actuators driven from the guidance and control system 34. Synchros are one type of suitable rotary actuator for such stub vortex generators, and they may also be operated by suitable hydraulic rotary actuators.

FIG. 5 is a side view, on a reduced scale, of another embodiment of my invention. In this embodiment all the parts are essentially as described with respect to the embodiment of FIGS. 1 and 2 except that alternative positions of the stators or stub vortex generators are shown closer to the impeller 12.

The self-propelled spherical vehicle described herein has the characteristic that when moving toward or at a grazing angle with a solid surface, it tends to roll into a position where it is heading directly into, or normal to, the surface with the propeller turning at the rear. The thrust is through the center and has a moment around the contact point in a direction to place the thrust axis normal to the surface with which it is in contact. In FIG. 6(*a*) a spherical vehicle 40 is shown approaching a solid surface 42 at an angle as indicated by the arrow T. FIG. 6(*b*) shows the vehicle 40 at the point of making contact with the surface 42. The thrust T from the propeller or impeller is opposed at the point of contact by a first vector N normal to the surface and a second vector F parallel to the surface which is not opposed, resulting in rotation of the vehicle 40 in the direction of the arrow. This rotation continues until the vehicle reaches a position where the thrust force T is normal to the surface 42 as shown in FIG. 6(*c*) at which point there is no further horizontal force tending to cause rotation of the vehicle.

FIG. 6(*d*) is a diagram similar to 6(*b*) except that, in this view, the surface 42 is moving in the direction indicated by the arrow V. In this situation, a drag force is present, causing the vehicle 40 to retain an angled position relative to the thrust angle in a downstream direction.

I claim:

1. A self-propelled spherical vehicle comprising a generally spherical housing and an impeller external of said housing, an energy source and power means in said housing connected to cause rotation of said impeller, said impeller being at the rear of said vehicle with respect to its direction of motion, characterized in that said impeller is adjacent said housing and approximately half the diameter of said housing and spaced such that the maximum circle of rotation of said impeller is approximately 7% of the diameter of said spherical housing from the surface of said housing such that it inducts a substantial part of the boundary layer at the rear of the vehicle to thereby reduce the drag on the vehicle caused by separation of the fluid over its surface, said housing and said impeller substantially defining the configuration of said vehicle, and means carried by said housing for effecting steering thereof.

2. A vehicle as set forth in claim 1 wherein the center of gravity of said sphere is substantially below the geometrical center of said sphere.

3. A vehicle as set forth in claim 1 wherein said impeller includes a hub of substantial diameter near said spherical housing and tapering to the rear to assist in assuring attached flow over said housing.

4. A vehicle as set forth in claim 1 wherein a plurality of stub vortex generators is located at the rear of said housing to insure flow attachment into the entrance of the impeller and angled such that flow across said stub vortex generators acts to counter the torque of said impeller.

5. A vehicle as set forth in claim 4 wherein at least some of said stub vortex generators are movable to provide roll stabilization of said vehicle.

6. A vehicle as set forth in claim 4 wherein said impeller is of the actuator disk type and has a diameter at least approximately 50 percent of the diameter of said housing.

7. A vehicle as set forth in claim 1 wherein said steering means comprises a plurality of drag pins and actuators therefor located aft of the circle of maximum width of said sphere with respect to its direction of motion, said pins being extendible into the flow around said vehicle to effect steering thereof.

8. A vehicle as set forth in claim 7 wherein a plurality of stub vortex generators are located at the rear of said housing to insure flow attachment into the entrance of the impeller and angled such that flow across said stub vortex generators acts to counter the torque of said impeller.

9. A vehicle as set forth in claim 1 wherein said impeller is of the actuator disk type and has a diameter at least approximately 50 percent of the diameter of said housing.

10. A self-propelled spherical vehicle for operation in a fluid medium comprising a housing and an impeller external of said housing, an energy source and power means in said housing connected to cause rotation of said impeller, said motion, characterized in that said impeller is adjacent said housing and approximately half the diameter of said housing and the maximum circle of rotation of said impeller is spaced approximately seven percent of the diameter of said spherical housing from the surface of said housing such that it inducts a substantial part of the boundary layer at the rear of the vehicle to thereby reduce the drag on the vehicle caused by separation of the fluid over its surface, said housing and said impeller substantially defining the configuration of said vehicle, said impeller including a hub of substantial diameter adjacent said spherical housing and tapering to the rear to assist in assuring attached flow over said housing, and a plurality of stub vortex generators are located at the rear of said housing to insure flow attachment into the entrance of the impeller and angled such that flow across said stub vortex generators acts to counter the torque of said impeller.

* * * * *